United States Patent [19]

Salete-Garces

[11] Patent Number: 4,583,455

[45] Date of Patent: Apr. 22, 1986

[54] SCREEN AND ROTOR ASSEMBLY FOR GRAIN HUSKING, DECORTICATING, POLISHING AND WHITENING MACHINES

[76] Inventor: Felipe Salete-Garces, Av. Ano de Juarez 198, Col. Granjas San Antonio, Deleg. Iztapalapa 09070, Mexico

[21] Appl. No.: 625,282

[22] Filed: Jun. 27, 1984

[30] Foreign Application Priority Data

May 14, 1984 [MX] Mexico ..... 201341

[51] Int. Cl.[4] ..... B02B 3/00

[52] U.S. Cl. ..... 99/519; 99/523; 99/528; 99/603; 99/607; 99/608; 99/617

[58] Field of Search ..... 99/602–607, 99/610–615, 617, 523, 608, 617, 622, 618, 628, 518, 519, 525–528; 241/86.1, 88.2, 93; 51/4, 22, 72 R; 426/481–483

[56] References Cited

U.S. PATENT DOCUMENTS 1,099,317 6/1914 Shultz ..... 99/606

4,292,890 10/1981 Salete-Garces ..... 99/606 X

*Primary Examiner*—Timothy F. Simone

*Attorney, Agent, or Firm*—Fleit, Jacobson, Cohn & Price

[57] ABSTRACT

A screen and rotor assembly for a grain husking, decorticating, polishing and whitening machine, and including an abrading screen supported by a screen holder, and an abrading rotor concentrically arranged within the abrading screen. The spacing between working surfaces of the abrading screen and the abrading rotor is maintained at a constant value, despite wear of the abrading surfaces thereof, by a plurality of axially extending channels in the screen holder for housing a corresponding plurality of abrading members such that the abrading members in turn support the edges of a plurality of alternate screen members located between each pair of consecutive channels, the channels being provided with a plurality of adjustable fasteners for holding the abrading members and for adjusting the radial position thereof. A pair of axially extending grooves is formed on the rotor means, each groove housing an abrading insert and being provided with adjustable fasteners for holding the inserts and for adjusting the radial position thereof, whereby regardless of wear the spacing between the abrading members and the abrading inserts can be maintained at a constant value.

12 Claims, 9 Drawing Figures

FIG. 3
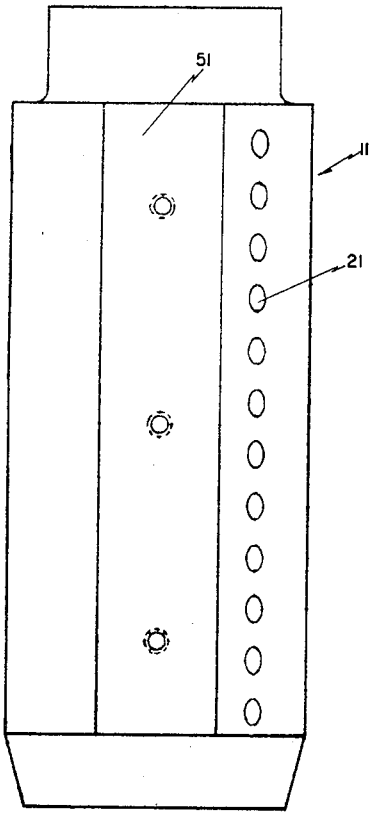
FIG. 4
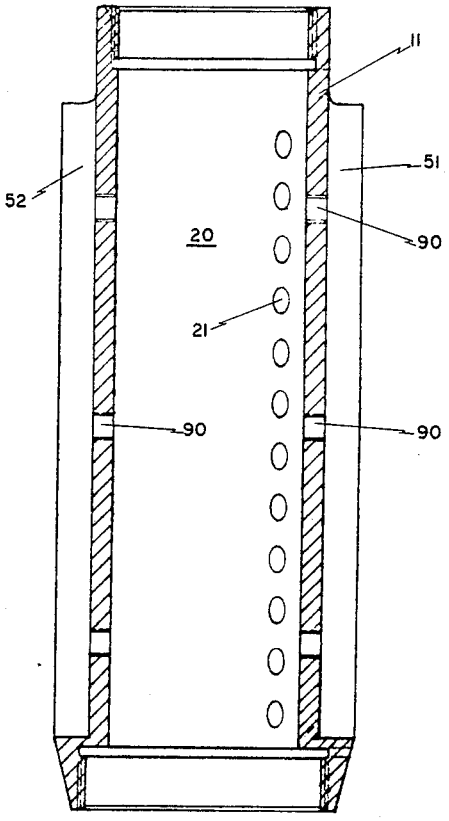
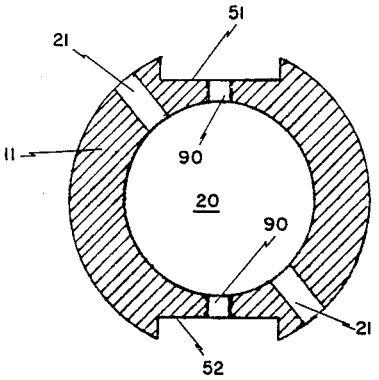
FIG. 5

SCREEN AND ROTOR ASSEMBLY FOR GRAIN HUSKING, DECORTICATING, POLISHING AND WHITENING MACHINES

FIELD OF THE INVENTION

The present invention refers to a screen and rotor assembly for grain or cereal treating machines and, more particularly, to a screen and rotor assembly suitable for machines for polishing, whitening, decorticating or husking grains and cereals and more particularly of rice grains.

BACKGROUND OF THE INVENTION

Air-swept machines for husking, polishing or whitening cereal grains are very well known in the art and many types thereof are extant in the marketplace.

However, the machines for husking and/or polishing cereal grains extant in the prior art, generally have to be set to work in separate stages, namely, a husking stage and a polishing and/or whitening stage, and with the proviso that the husking machines which are introduced in the first stage must deliver completely husked grain to the polishing machines, because the latter are uncapable of handling unhusked grains, whereby the husking stage generally needs several steps carried out by tandems of husking machines and/or by husking machines followed by unhusked grain removing machines.

Different designs of polishing machines are also well known but, up to the present time, there are very few machines designed that may effect a complementary husking of the grain to avoid the use of unhusked grain removing machines, and only said very few machines accomplished the goal of also polishing the grain in one single step with the posthusking step, with the consequent increases in the cost of fully husking the grains and the consequent cumbersome procedure that must be used with said type of tandem husking machines and unhusked grain removing machines to deliver a fully husked grain to the polishing machines.

Among the most well known grain polishing machines are those using emery cones or emery cylinders to polish the grains by means of rubbing of the same with emery, thus producing a polished grain and flour from the rubbed portions thereof. These machines, however, are extremely bulky and heavy and their operation requires high power consumption, whereby the process carried out thereby is rather costly.

Many compact type horizontal polishing machines for grains, particularly rice, are also known, but this compact type machines use a rotor the rotation of which causes intermittent projection of the grains that therefore are accelerated or decelerated, depending on the cycle involved, whereby the treating of the grain is harsh and irregular and a large amount of breakage of said grains occurs.

On the other hand, most of the well known air-swept polishing machines for cereal grains generally have resource to a cylindrical rotor and a polygonal indented screen, because it was believed up to the present time that the use of such polygonal indented screen would increase the performance of the apparatus, in view of the further obstructions produced by the corners of said polygonal screen which generally was shaped in an hexagonal form. However, it has now been discovered that there is no reason whatsoever for maintaining the polygonal, particularly hexagonal shape of indented screens, because the said screens used in most of the prior art polishing machines for grains, do not have the previously believed performance and rather tend to produce, when the screen has few sides, heavy accumulation of grains in the corners of the screen, with the consequent disadvantage that this accumulation may produce.

The screen type machines of the prior art, on the other hand, generally use inadequately distributed indentations in the screens that interfere with the slots of the screen, thereby forming extremely sharp protuding edges that materially form sharp knives that, rather than polishing or husking the grain, cut the surface thereof and many times cut through the bodies of said grains with the consequent breakage and the obvious insatisfactory uniformity of the polishing or husking action achieved thereby.

Most of the above described drawbacks shown by all the prior art husking and polishing machines, particularly for rice, have been solved by the whitening and polishing machine of U.S. Pat. No. 3,960,068 to Felipe Salete, the same applicant of the instant application. Said patent discloses an air-swept polishing machine for rice which comprises a housing, a hollow rotor within said housing, feed means to admit grain into the housing, a screw conveyor at the lower part of said rotor for conveying the grains upwardly into the treating section of the machine which is arranged at the upper part of said rotor, a cylindrical indented screen in said treating section and a rotor having a pair of retractible knives to retain the movement of the grains at will, whereby the pressure applied by said screw conveyor upwardly of the machine, pushes the grain to be trapped by said rotor which spins the mass of grains against the action of the indented screen, thus rubbing the grains one to each other and against the walls of the rotor and the walls of the indented screen, to thereby polish the grains. The flour which is removed from the grains is entrained in a stream of air which is forced through the hollow rotor and outwardly thereof through suitable bores, in order to traverse the mass of spinning grains and the screen, and driving said flour from the treating chamber of the machine to be thereafter appropriately collected in an appropriate receptacle.

The treated grains are in turn pushed upwardly against a centrifugal extractor, which expels the same outwardly of the machine.

The above described machine of U.S. Pat. No. 3,960,068, however, does not solve the problem extant in practically all rice mills, namely, that if the rice is not properly husked in the husking section or machines, an additional husking operation and or unhusked grain removing operation is required in the husking stage, because the machine is unable to husk the unhusked grains received.

One other husking and polishing machine is the subject matter of U.S. Pat No. 4,292,890, to Felipe Salete, which solves the problems of the prior art machines including that of U.S. Pat. No. 3,960,068, by the incorporation of a new type of screen and rotor assembly, which comprises a cylindrical rotor having two particularly designed fluted knives tangentially arranged thereto, such that the grains are gradually pressed when trapped by each knife which is inclined outwardly of the periphery of the rotor contrary to the direction of movement of the same, and a screen supported by a specially designed screen holder, which comprises two semi-cylindrical screen members having appropriately distributed indentations to avoid sharp edges thereof, and which are attached and fastened to said screen holder at the edges of said semi-cylindrical screens, by means of the introduction of a pair of stationary knives, which are also fluted knives, said fluted knives having the flutes directed in such a manner that the flow of grains in the treatment chamber of the machine is forced downwardly while the stream of grain is pushed upwardly by the screw type conveyor which may be provided with abrasive material on the attacking face thereof, thus producing a higher compression of the grains, that are therefore rubbed with more energy and that therefore may be partially husked and polished and whitened in one single step.

This highly improved type of polishing and husking machine, however, still requires the provision of a husking stage before receiving the grain, because even with the highly improved characteristics of the screen and rotor assembly, it is unable to completely husk the grain and also polish the same in one single step.

It is therefore very well known that the workers in the art of husking and polishing cereal grains have long sought a machine that may be able to overcome the above described drawbacks and particularly a machine that may perform, in one single step, both full husking of the grains, as well as polishing thereof, in order to solve the very serious problems extant up to the present time in all prior art cereal mills, namely, that the husking machines generally must perform a husking operation with a very high efficiency and degree of husking, in order that the polishing machines may be capable of either only polishing the completely unhusked grains, or of only partially husking the still unhusked grain reaching the same, or requiring an unhusked grain removing stage, with the consequent increases in cost and efficiency of the mill.

It is to be pointed out that many machines of those described above are highly efficient for carrying out their husking and polishing actions, and that the only defective part thereof in order to accomplish the above mentioned goals, is the screen and rotor assembly, which up to the present time has not been designed in such a manner that it may, in conjunction with the other parts of the husking or polishing machines, accomplish the goal of completely husking the grain and at the same time rubbing the same gently in order to polish it.

BRIEF SUMMARY OF THE INVENTION

Having in mind the defects of the screen and rotor assemblies of prior art grain husking or polishing machines, it is an object of the present invention to provide a screen and rotor assembly for any kind of air-swept, screen type husking or polishing machines, which may accomplish in one single step, in conjunction with the other mechanisms of the husking or polishing machine, complete husking and polishing of cereal grains in one single stage.

It is another object of the present invention to provide a screen and rotor assembly for husking and/or polishing machines, that will be capable of fully husking the grains fed thereto, without however requiring important changes in the structure of the remaining parts of the machine.

It is another object to the present invention to provide a screen and rotor assembly of the above mentioned character, which may be used in conjunction with either cylindrical, polygonal or frustoconical screen machines.

Still one other object to the present invention is to provide a screen and rotor assembly of the above mentioned character, which will be capable of carrying out the husking and/or polishing action with low energy consumption and low space requirements and will be capable of installation in either vertical or horizontal types of machines.

One other and more particular object of the present invention is to provide a screen and rotor assembly for grain husking and/or polishing machines, of the above mentioned character, that will be capable of permitting easier removal of the screen for cleansing or replacement purposes.

One other object to the present invention is to provide a screen and rotor assembly for grain husking and polishing machines, of the above described character, which will permit treatment of grains of different sizes and shapes through the mere adjustment of certain elements of the screen and rotor assembly.

Another object to the present invention is to provide a screen and rotor assembly for grain husking and polishing machines, which will be of a very simple construction and will have full capability for being inserted and/or removed from the machine as a unit, by the mere loosening of a number of fasteners.

Another and more particular object of the present invention is to provide a screen and rotor assembly for grain husking and/or polishing machines, of the above described character, which may be designed to replace prior art screen and rotor assemblies in any type of either cylindrical or conical screen type machines, without any appreciable changes in the structural parts of said machines.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of certain specific embodiments, when read in connection with the accompanying drawings, in which:

FIG. 3. is a cross-sectional elevational view of the rotor of the screen and rotor assembly in accordance with the present invention, showing one of the diametrically opposed grooves for housing the abrading inserts of said rotor;

FIG. 4 is a view similar to FIG. 3 but taken at an angle of 90° with respect thereto, in order to show in cross-section the two diametrically opposed grooves;

FIG. 5 is a cross-sectional plan view of the rotor shown in FIGS. 3 and 4, in order to show the arrangement of the grooves and the bores for air conduction;

DETAILED DESCRIPTION

Having now more particular reference to the drawings and more specifically to FIG. 1 thereof, the screen and rotor assembly of the present invention will be described as associated with a grain husking and polishing machine built in accordance with U.S. Pat. No. 4,292,890, but it must be borne in mind that the screen and rotor assembly of the present invention may be applied not only to said husking and polishing machine of U.S. Pat. No. 4,292,890, but rather is of general application to any husking or polishing machine for grains, provided that said machine is a screen type machine and preferably of the air-swept type. Therefore, the following description of the various embodiments of the screen and rotor assembly of the present invention, described in connection with the husking and polishing machine of U.S. Pat. No. 4,292,890, must not be regarded as restrictive of the instant application, but rather merely as illustrative thereof since the screen and rotor assembly is of general application and its description in connection with said machine is given only for the sake of clarity in the specification.

Figure 1:
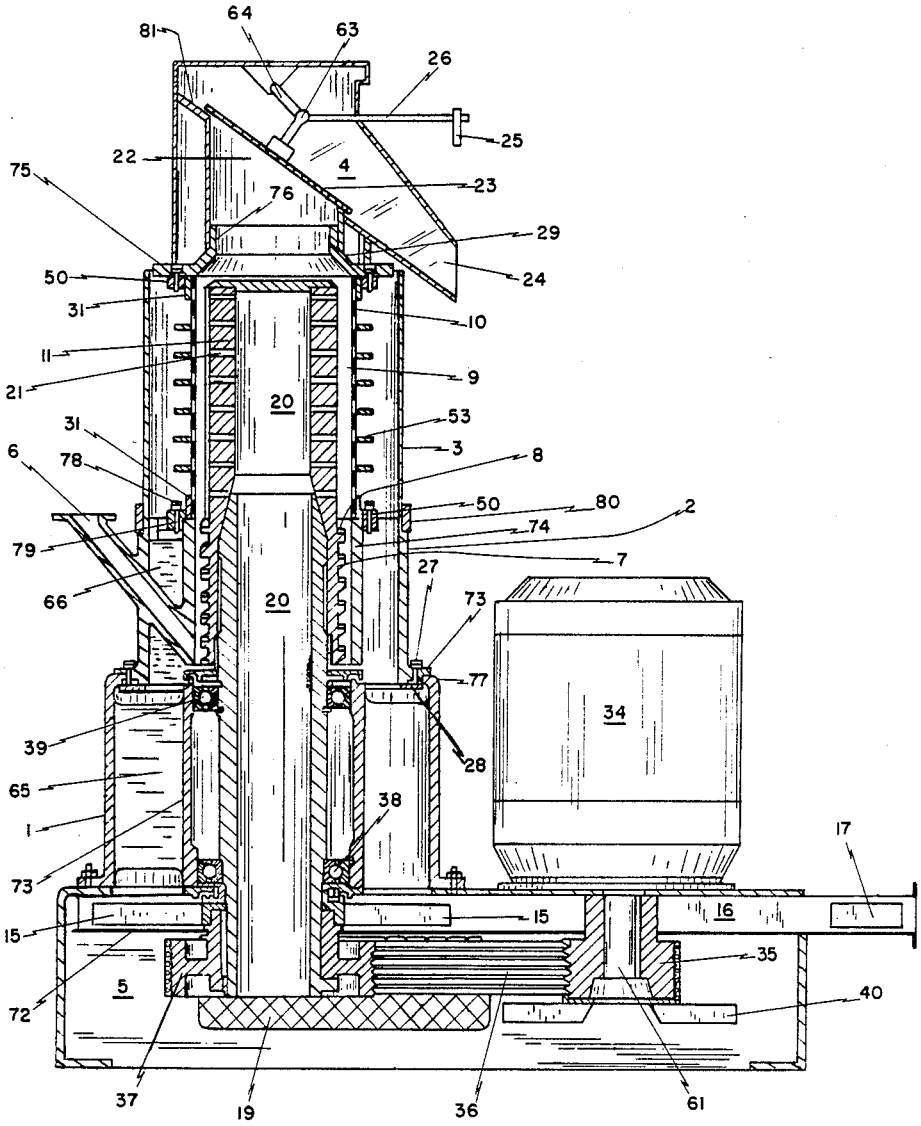
FIG. 1 is a cross-sectional elevational view of a grain husking and polishing machine of U.S. Pat. No. 4,292,890 to which the screen and rotor assembly of the present invention has been incorporated.

Having now more particular reference to FIG. 1 of the drawings, a grain husking and polishing machine in accordance with U.S. Pat. No. 4,292,890 is illustrated, which essentially comprises a grain treating housing formed by a lower or first housing section 1 mounted on top of the base box 5; a second housing section 2 mounted on top of section 1 and containing an inlet 6 for grain to be treated, said section 2 being rotatably displaceable with respect to section 1; a third housing section 3 mounted on top of section 2 and having a wall of a transparent nature, built for instance of a plastic transparent material or the like, and which contains all the main treating elements of the machine, that is, the screen and rotor assembly built in accordance with this invention and that will be described in more detail hereinafter, the transparent housing section 3 thus permitting continuous inspection of the treatment of the grain for appropriate control of the machine, and a top or fourth housing section 4 mounted on the upper end of the transparent section 3 and being rotatably displaceable with respect thereto, wherein the outlet 24 for treated grains is arranged. In view of the fact that sections 2 and 4 are rotatably displaceable with respect to the other sections, both the inlet 6 and the outlet 24 for grain may be moved to any desired position around the machine.

A motor unit 34 is also mounted on top of the base box 5, the latter serving as a housing for the drive elements between the motor 34 and the machine. Air may be driven into the base box 5 and through the machine by providing a window 19 covered by a suitable wire mesh and husk, flour and bran-ladden air may be exhausted through the exhaust duct 16 which may be controlled by means of a suitable damper 17.

More particularly, the grain husking and polishing machine built in accordance with U.S. Pat. No. 4,292,890 comprises a base box 5 on the top of which top a first or lower cylindrical housing section 1 is fixedly mounted by means of bolts and the like, said lower housing section having an inner cylindrical member 73 fixedly concentrically mounted within housing section 1 by means of a plurality of brackets such as that indicated by the reference numeral 65. On the top of the cylindrical housing 1 a radially inwardly directed flange 77 is provided for the purpose of receiving a movable second cylindrical housing section 2, which has a lower radially outwardly directed flange 73 abutting said flange 77 of housing section 1, for the purpose of providing for the displacement of the second housing section 2. The mounting of housing section 2 on housing section 1 for the purpose of enabling the displacement of housing section 2 with respect to housing section 1 in rotative direction, comprises a planar ring 28 engaging the lower surface of flange 77 of housing section 1, and the above mentioned outwardly directed flange 73 located at the lower edge of housing section 2. The planar ring 28 and the flange 73 are engaged by means of a plurality of bolts 27 which are normally tightened when the machine is in operation but that may be loosened in order to enable rotation of the housing section 2 in any direction and to any position with respect to housing section 1. Housing section 2 has a grain inlet 6 diagonally mounted across the wall thereof, and an inner cylindrical member 74 is fixedly mounted concentrically inwardly of housing section 2, and coaxially above the cylindrical member 73 of housing section 1, by means of a plurality of brackets 66.

On top of the displaceable cylindrical housing section 2 there is mounted a third cylindrical housing section 3 engaged to the cylindrical housing section 2 by any suitable means such as the surrounding band 80.

Concentrically arranged within housing section 3, the screen and rotor assembly of the present invention is mounted as shown, said assembly comprising a screen 10, which will be described in detail hereinafter, mounted coaxially above the inner cylindrical member 74 of housing section 2, by means of a screen holder which is more clearly shown in FIG. 2 of the drawings and comprising an upper and lower ring 31 provided with a plurality of lugs 50 having suitable bores 51. Both rings 31 are joined together by means of vertical struts 32 and a plurality of planar rings 53 may be arranged between struts 32 in order to maintain the shape of the said screen 10 unaltered. The lower lugs 50 of the screen holder are fixedly mounted on matching lugs 79 provided on the outer surface of the top of inner cylindrical member 74, by means of bolts 78, whereas the upper lugs 50, fixed on the upper ring 31 of the screen holder, are used to mount thereon a cone-like member 29 by means of the outer flange 75 of said cone member 29 and a plurality of bolts 30 which engage said flange 75 to the plurality of upper lugs 50 of the screen holder.

Spanning the whole length of the cylindrical housing sections 1, 2 and 3, an inner hollow rotor member 20 is provided, concentrically inwardly of the inner cylindrical members 73 and 74 and the screen 10, for a purpose to be described hereinbelow, said rotor 20 being rotatably mounted by means of two suitable bearings 38 and 39, with bearing 38 being fixed on the inner wall of the lower portion of the cylinder member 73 and bearing 39 being fixed on the inner wall of the upper portion of said cylindrical member 73, so as to secure alignment of the rotor 20 with respect to the inner cylindrical members 73 and 74 and with the screen 10.

Mounted by means of a threaded portion 62 and outwardly of the rotor 20, there is a screw conveyor provided with a helical rib whose upper wall is thoroughly lined by means of an abrasive and wear resistant lining 8 for prehusking the grain.

Aligned with and on top of the screw conveyor 7, an upper projection 11 of the rotor 20 (hereinafter called rotor 11) is provided, wherein a plurality of vertical lines of bores 21, as more clearly shown in FIG. 3 of the drawings is provided also for a purpose to be described hereinbelow. This perforate rotor 11 is located concentrically inwardly of the screen 10 forming a space 9 therebetween which serves as the husking and polishing chamber of the machine, to be called hereinafter the treating chamber 9.

On the top of the cylindrincal housing section 3, there is mounted a fourth or upper cylindrical housing section 4, which is provided with the above described outlet 24 for treated grain and which contains an inner cylindrical member 22 fixedly and concentrically mounted within housing section 4 by means of brackets such as the one indicated by means of reference numeral 81. The inner cylindrical member 22 has an open slant top end covered by means of a lid 23 which is movable by being mounted on a hinge 63 which connects with an intermediate toggle portion of a bar 26 extending outwardly of the housing section 4 and having near its outer end a displaceable weight 25 for maintaining the lid 23 permanently engaged to the slant open end of the cylindrical member 22. The inner end of bar 25 is rockably supported on hinge 64 fixed on the upper cover of housing section 4, in order to provide for the movement of lid 23 from an open position to a closed position against the slant open end of the cylindrical member 22.

The housing section 4 is also rotatably displaceable with respect to the cylindrical housing section 3 by the provision of a mounting comprising a cylindrical upper portion 76 of the cone member 29, around which the inner cylindrical member 22 is mounted with a snug fit, whereas the lower edge of the cylindrical housing section 4 rests on the flange 75 of said conical member 29. By this type of mounting, the whole of the top cylindrical housing section 4 may be moved to any position around the circumference, by merely forcing the inner cylindrical member 22 to rotate sliding against the cylindrical portion 76 of conical member 29, while the said housing section 4 is supported on top of the flange 75.

Figure 6:
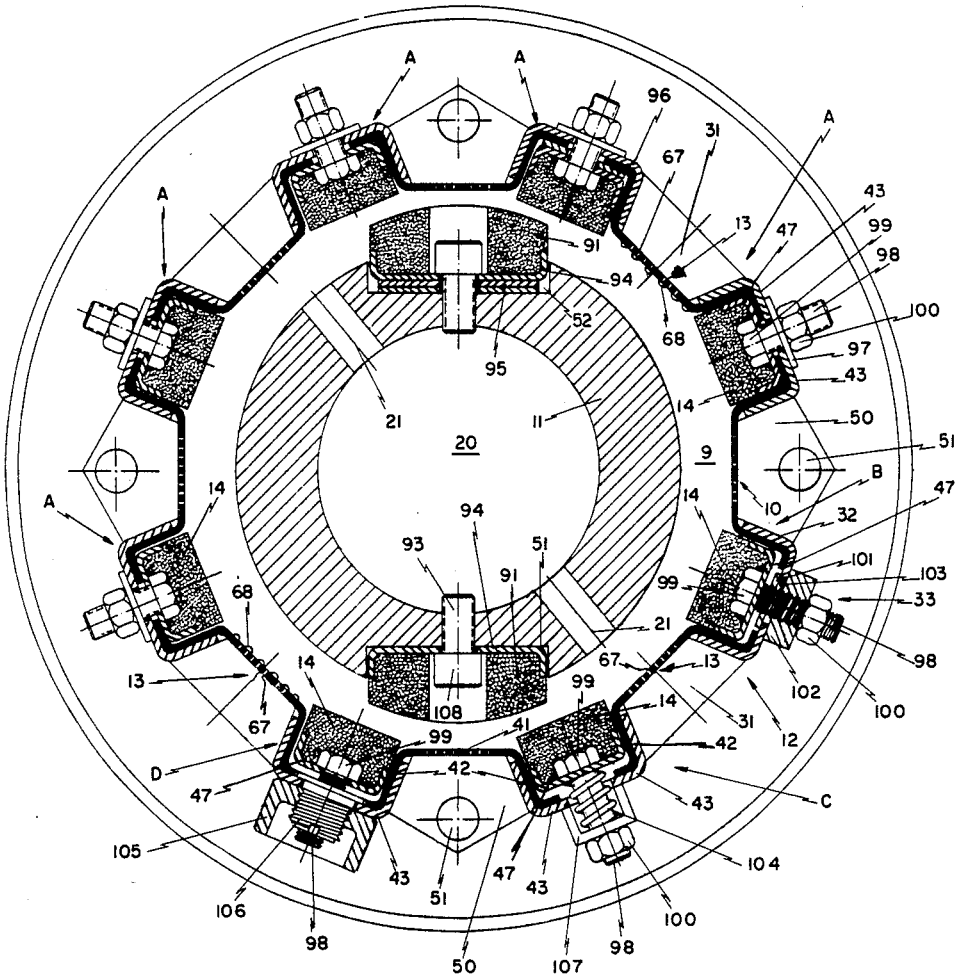
FIG. 6 is a cross-sectional plan view of the screen and rotor assembly built in accordance with an embodiment of the present invention, showing the arrangement of the rotor and screen, as well as various mountings for the abrading members.
Figure 9:
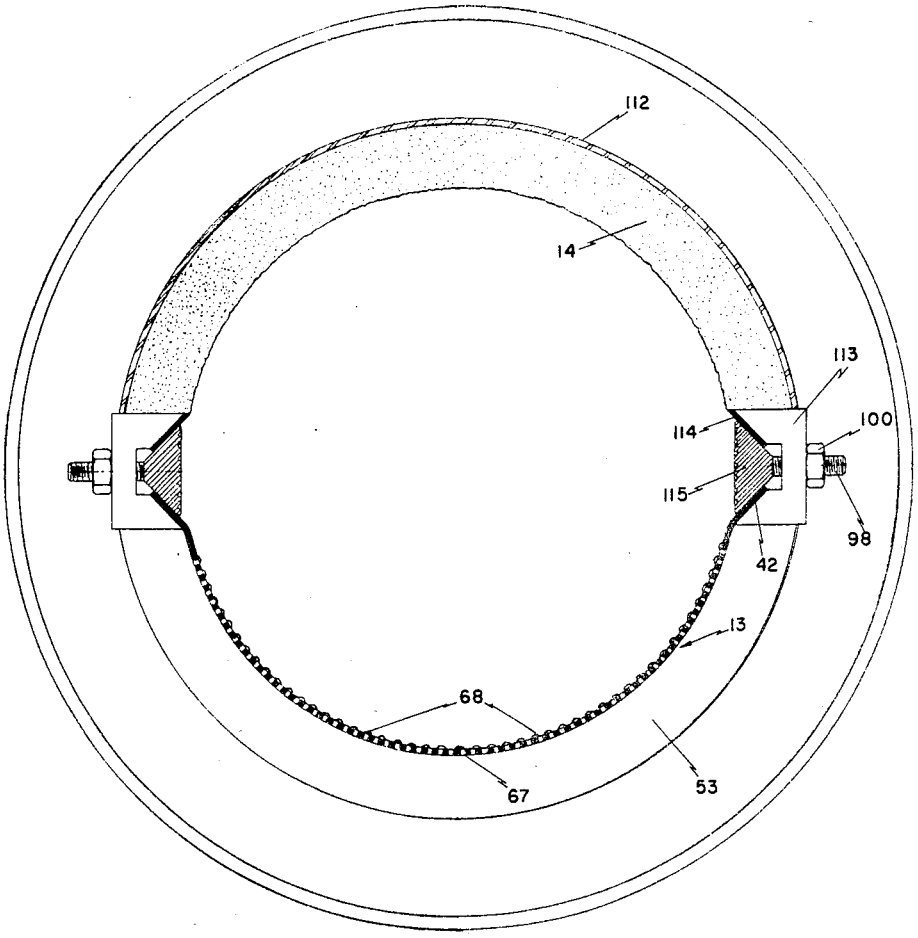
FIG. 9 is a cross-sectional plan view of the screen and rotor assembly built in accordance with one other embodiment of the present invention.

The screen 10, as more clearly shown is FIG. 2 of the drawings, may be provided with a plurality of indentations 68 (as shown in FIGS. 6 and 9) throughout the surface of the said screen 10, the indentations 68 projecting inwardly of the screen 10, in order to provide teeth for trapping and rubbing grain which reaches the chamber 9 as will be described more fully hereinbelow.

Around the lower open end of the hollow shaft 20, a pulley 37 is fixedly mounted, said pulley being engaged, by means of the bands 36, to a pulley 35 engaged to the shaft 61 of motor 34 also mounted on base box 5. The pulley 35 on the shaft 61 of the motor 34 is provided with a plurality of fan blades 40 capable of blowing air to cool the bands and pulleys contained within the base box 5. Above the pulley 37 and fixedly mounted on shaft 20, there is provided a fan having a plurality of vanes 15 arranged within a volute-type housing 72, said housing 72 being connected to the exhaust duct 16 for husk, flour and bran-laden air, said duct being connected to a pneumataic conveyor (not shown) which applies a high vacuum suction thereto and being provided, outwardly of the base box 5 with a damper 17 to regulate the exhaust.

In order to fully understand the operation of the screen and rotor assembly built in accordance with the various embodiments of the present invention which will be described with full detail hereinafter, a brief description of the operation of the machine of U.S. Pat. No. 4,292,890 will be given hereinafter, under the understanding that the screen and rotor assembly in accordance with the present invention may be applicable not only to the machine mentioned above, but also to any other kinds of screen type husking and/or polishing machines extant in the prior art.

Grain is loaded through chute 6 to be trapped by the screw conveyor 7, the attacking surface of which as mentioned above is covered with an abrasive material 8, so that said screw conveyor elevates the grain received and at the same time rubs the same in order to loosen the husk thereof. The prehusked grain is then pushed upwardly into the treating chamber 9 formed between the rotor 11 and the screen 10 which will be described in more detail hereinafter, wherein an energetic rubbing action is applied to the grain, fully removing the husks from the grain and polishing the grain in one single step within the treating chamber 9. The grain continues its movement upwardly into the conical section 29 of the upper housing 4, and the pressure exerted by the screw conveyor 7 forces the grain upwardly against the pressure exerted by the lid 23 controlled by the weight 25, thus lifting the lid and permitting the grain to exit the machine through the outlet 26.

At the same time, the fan blades 15 create a vacuum throughout the various chambers of the machine, pulling the air through the protecting screen 19 of box 5, upwardly through the hollow shaft 20 and outwardly through the bores 21 of rotor 11, then through the treating chamber 9 wherein the grain is being energetically rubbed, and through the orifices or slots 67 of screen 10, and back downwardly through the housings 3, 2 and 1, to be displaced through duct 16 regulated by the damper 17 into a vacuum type air conveyor of known type which carries the husk, flour and bran to other parts of the mill for further treatment or discarding.

Although the screen and rotor assembly built in accordance with the present invention may adopt, as mentioned above, many different shapes, the said assembly may be described hereinbelow having reference to a cylindrical type assembly, under the understanding that said screen and rotor assembly may be built in any other desired manner, such as frustoconical, pyramidal, polygonal and the like.

Figure 2:
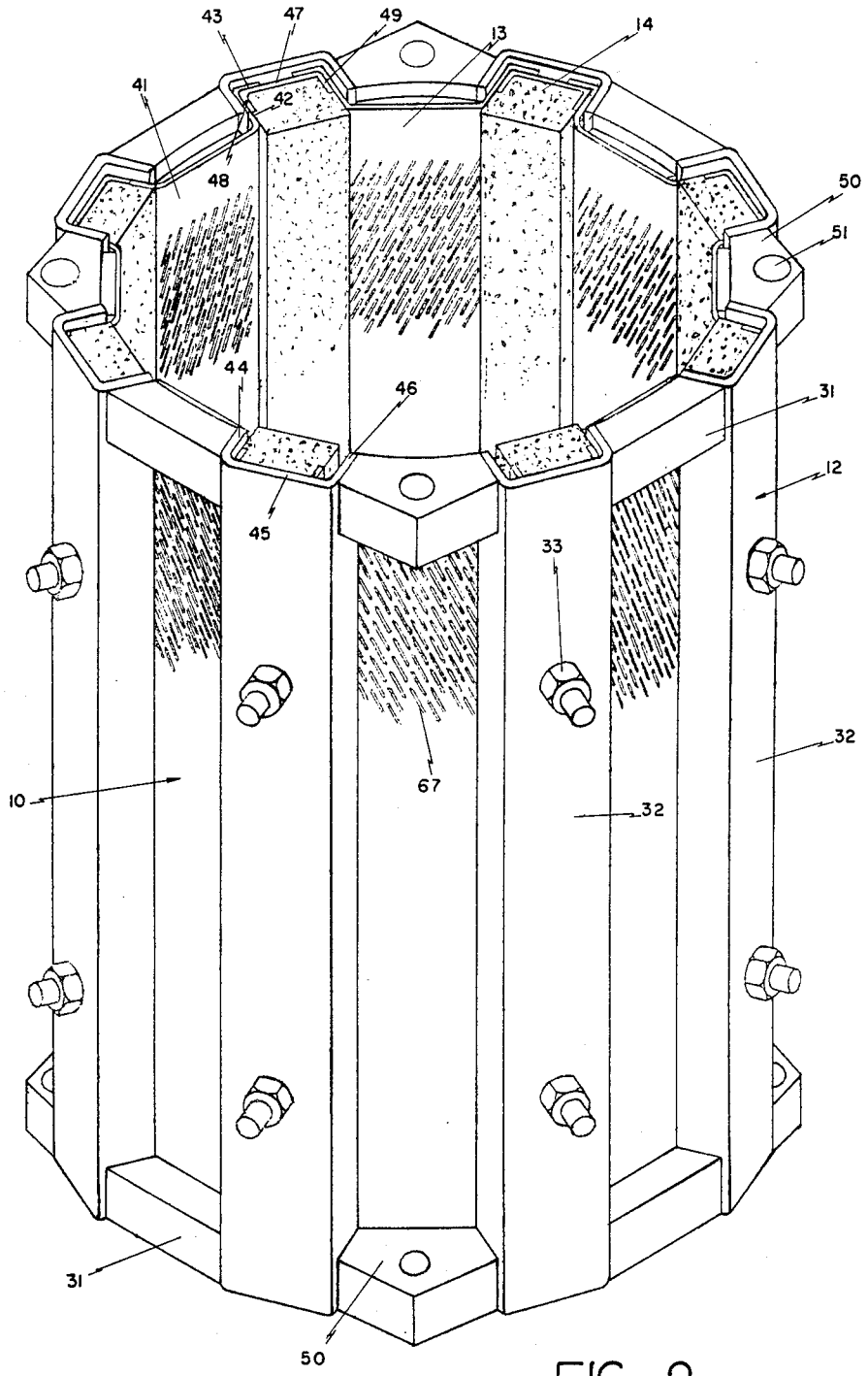
FIG. 2 is a perspective view of a screen and screen holder subassembly built in accordance with one embodiment of the present invention, showing a plurality of screen sections alternated with a corresponding plurality of abrading sections.

The arrangement of the screen holder and screen of the assembly of the present invention is more clearly illustrated, in accordance with one embodiment of the invention, in FIG. 2 of the drawings, wherein it may be seen that the screen holder 12 comprises an upper rim 31 and a lower rim 31 which is built by means of ring sections attached, such as welding, to vertical struts in the form of hollow channels 32, in order to provide a cylindrical screen holder as clearly shown in said FIG. 2 of the drawings. Between each pair of channel members 32, which together with the ring segments 31 form the screen holder 12, a particularly designed abrading screen 10 is incorporated, comprising a plurality of screen members 13 and a corresponding plurality of abrading members 14, alternated to each other and provided in any desired number starting from one screen member 13 and one abrading member 14 (as shown in FIG. 9) each covering one half of the circumference, up to any desirable reasonable number of alternated screen members 13 and abrading members 14.

Each screen member 13 is built, as clearly shown in FIG. 2 of the drawings, of an attacking section 41, which may be either flat or curved, depending on the desirability of a polygonal or a cylindrical screen 10, and the said attacking section 41 is followed, on each side edge thereof, with a flange 42 directed at an angle to said front or attacking section 41, which flange 42 is in turn followed by a second flange 43 directed at an angle of approximately 90° with respect to flange 42, so as to attach said screen members 13 to be introduced behind and fixed by the abrading members 14, by the arrangement of said screen members 13 such that their front or attacking portion 41 extends inwardly of each one of said ring segments 31 and said lugs 50 for fixing the screen holder 12, and the flanges 41, 43 introduced within the hollow channels 32 as shown in FIG. 6 of the drawings. Therefore, all the flanges 43 at each side of each screen member 13, will be fixed by the abrading members 14, which are built in the form of elongated blocks, preferably with a metal cover on the back, formed by a bottom 47 and two side walls 48 and 49, thoroughly embedded on the back portion of said abrading members 14, so as to press upon the flanges 43 and 42 of the screen members 13, in order to fix the assembly together. Each of said abrading members 14 may be built of any abrasive material such as emery, but may also be metallic members with flutes or teeth in the form of files and the like, in order to enable them to rub energetically over said grains which are introduced in the treating chamber 9 of the assembly, for the above mentioned purpose of obtaining a highly energetic rubbing which will husk and polish the grains.

Each abrading element 14 is fixed to the bottom section of each channel 32 by means of suitable bolt and nut assemblies 33 as will be described in more detail hereinbelow.

The rotor part of the screen and rotor assembly of the present invention is more clearly illustrated in FIGS. 3, 4 and 5 which show a cylindrical embodiment of said rotor, but again it must be stressed that said rotor may be of any other desired form, such as frustoconical or the like. The rotor of the screen and rotor assembly of the present invention comprises a hollow cylinder 11 having a hollow space 20 for the conduction of air as described above, said hollow cylinder 11 having at least a diametrically opposite pair of arrays of bores 21, also for the conduction of air from the hollow space 20 into the treating chamber 9, and said hollow rotor is provided with at least one pair of grooves 51 and 52, wherein suitable rotating abrading inserts are accomodated, as will be described in connection with FIG. 6 of the drawings. The inserts 91 (FIG. 6) are introduced within each one of the grooves 51 and 52, and a suitable fixing bolt 93, attached to a bottom channel 94 embedded in the rotating abrading member 91, is introduced through each one of the bores 90 of the hollow member 11, and fastened to said hollow member by any suitable means, such as by means of a suitable nut or any other fastening assembly, so as to retain the abrading inserts 91 in their position.

The rotor 11, obviously, is accomodated concentrically inwardly of the abrading screen 10, as shown in FIGS. 6 et seq, with the rotating abrading inserts 91 and the fixed abrading members 14 arranged at a suitable distance in order to obtain an energetic abrasion and rubbing of the grains which are introduced into the treating chamber 9 of the screen and rotor assembly of the present invention.

Referring now to FIG. 6 of the drawings, which illustrates an embodiment of the invention, and wherein different manners of fixing the abrading members 14 of the screen and screen holder subassembly are illustrated for the purpose of providing a clear view of the said different manners of attaching the abrading members 14 into the channels 32 of the screen holder and for fixing the flanges of the screen members 13, it may be seen that the screen and rotor assembly of the present invention, in accordance with a preferred embodiment again comprises the rotor 11 as described above, the abrading screen 10, and the screen holder 12, each one of said subassemblies comprising the parts already described in the above paragraphs, whereby it is not considered necessary to again describe the said parts. The various manners of attaching the abrading members 14 and screen 10 to the channels 32 of the screen holder 12 will be described hereinbelow having reference to each one of the different manners of such a connection illustrated in FIG. 6 of the drawings.

In channel 32 indicated by the reference character A, of which five channels are illustrated in the same manner, it may be seen that the abrading element is attached to a bottom metal channel 47 by any suitable means, such as welding or adhesive, and the head 99 of a bolt 98 is suitably welded to said metallic channel 47 at the bottom of the abrading element 14. The bolt passes through the corresponding bore of the channel A, and a washer 97 is placed on the outer face of said channel A, upon which a suitable nut 100 is threadedly inserted into bolt 98, in order to fix the abrading member 14 against the bottom of the channel A, pressing therebetween the flanges 43 of the screen members 13 as already described in connection with FIG. 2 of the drawings.

Referring now to the channel 32 indicated by the reference character B, a different manner of fixing the abrading member 14 to the channel B is illustrated and comprises a neck piece 102 made of metal, and having a neck 103 and a flange 101 in order to receive in said neck 103 the edge of the bore of channel B, and the bolt 98 is threadedly inserted in said neck piece 102, with the nut 100 tightened against said neck piece, in order to fix the position of the abrading element 14 within channel B. In this particular instance, it is preferred to insert shims such as those illustrated at 96 in FIG. 7 of the drawings, in order to press against the flanges 43 of the screen members 13, so as to fix the whole unit in a suitable manner. However, the fixing of the screen members 13 may be carried out by means of the provision of a suitable fastener between the section 42 of the flange of said screen members, and the corresponding section of channel 32, such as a bolt or a lug and complementary indentation between the two members, so as to fix the position of the screen member 13, without the need of inserting shims such as shim 96 between said members, when the position of the abrading member 14 is adjusted radially inwardly of the screen members 13 as shown in channel B of FIG. 6.

The embodiment shown in channel 32 indicated as C in FIG. 6 of the drawings, comprises a resilient mount provided by a compression spring 104 one end of which rests on an outer cup 107 fixed on the outside of the channel 32 (C) and the other end of which rests on the metal ferrule 47 provided at the bottom of the abrading member 14 as clearly shown in FIG. 6 of the drawings. The nut 100 is threadedly engaged over bolt 98 in order to compress the spring 104 and fix the position of the abrading element 14, which in this particular instance will act in a resilient manner, due to the said spring 104.

The embodiment shown at channel D of FIG. 6 of the drawings, comprises the provision of a suitable threaded member 106 threadedly engaged in an inverted cup 105 attached to the outer surface of channel 32 (D), and having an interiorly threaded bore, through which the bolt 98 is threadedly engaged in its desired position.

It may be seen from the above that the various manners of attaching the abrading members 14 to the screen holder 12 may be varied at will, without thereby departing from the true scope and spirit of the present invention.

The rotor 11 may be also provided, at the bottom of the grooves 51, and 52, with the corresponding abrading rotating inserts 91, fixed by means of bolts 93 threadedly engaged on the hollow member 11, and a ferrule 94 may be fixed at the bottom of said abrading insert 91, in order to trap the same by means of the head 108 of bolt 93, as clearly shown in FIG. 6 of the drawings. Also, one or more shims 95 may be inserted at the bottom of the grooves 51 or 52, between the ferrule 94 and the bottom of said grooves, in order to fix the desired position of the rotating abrading inserts 91, for the purpose of rubbing the grains within the treating chamber 9 in a more or less energetic manner.

Figure 7:
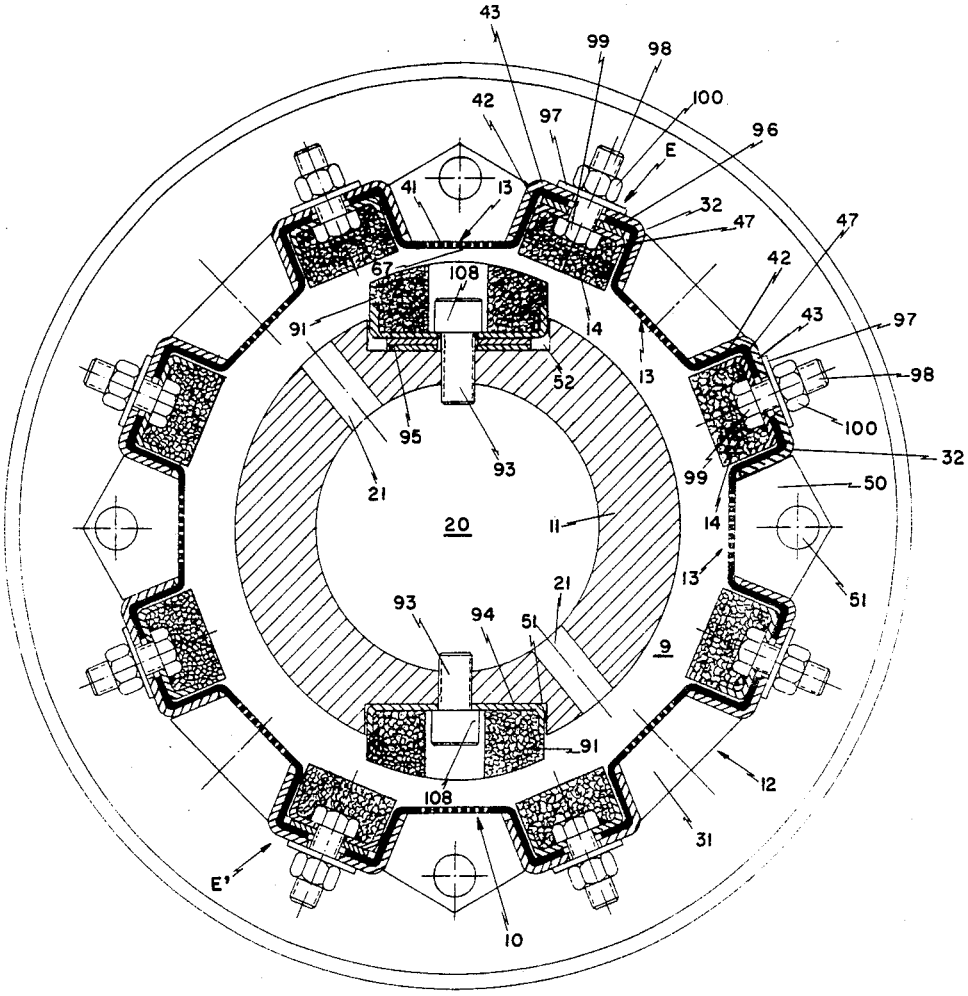
FIG. 7 is a cross-sectional plan view of the screen and rotor assembly built in accordance with a further embodiment of the present invention.

FIG. 7 of the drawings shows an embodiment of the invention which comprises a screen subassembly containing eight abrading members 14 and eight alternating screen members 13, as shown, all of them built in identical manner, that is, with the screen members 13 and abrading members 14 fixed to the channels 32 of the screen holder 12 by means of the connecting embodiment shown under A in FIG. 6 of the drawings, but with the additional characteristic that at least one pair E, E′ of abrading members 14 are provided with shims 96 to protrude a distance radially inwardly of the screen subassembly 10, in order to produce a more energetic rubbing of the grains at this section, with the remaining abrading members 14 being located inwardly of the channels 32, to produce a normal rubbing of the grains introduced into the grain treating chamber 9 between the rotor 11 and the screen 10.

One of the abrading inserts 91 of the rotor 11 may also be provided with one or more shims 95, in order to protrude outwardly of the outer surface of the rotor 11, in order to still increase the abrading and rubbing action on the grains in the grain treating chamber 9, when the grains are of such a nature, such as par-boiled rice, that are very hard to husk and polish. This protruding abrading members 14 and abrading inserts 91, accomplish a much more energetical action on hard grains such as par-boiled rice, in order to accomplish the goal of husking the same and at the same time polishing the grain to whiten the same.

The remaining parts of this embodiment are exactly as described above in connection with FIG. 6 of the drawings, whereby it is not considered necessary to furtherly describe the various parts constituting the same.

Figure 8:
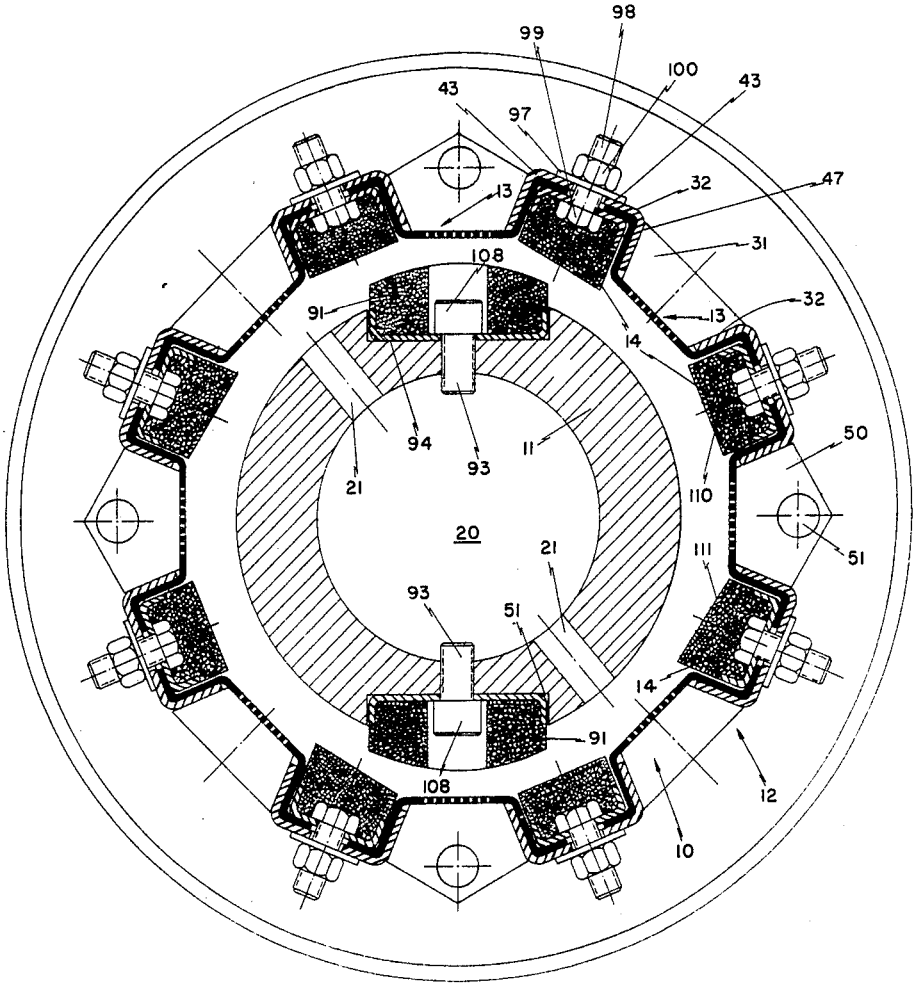
FIG. 8 is a cross-sectional plan view of the screen and rotor assembly built in accordance with an additional embodiment of the present invention.

FIG. 8 of the drawings illustrates a particularly preferred embodiment of the present invention, wherein the mechanisms for attaching the abrading members 14 to the channels 32 is the same as that shown and described under A in connection with FIG. 6 of the drawings, but with this embodiment having the characteristic that certain abrading elements 14 are provided with a flat exposed surface 110, whereas other of said abrading elements 14 are provided with a slant attacking face 111, which is inclined in relation to the direction of rotation of the grain such that the grain is gradually compressed from the front to the rear end of each one of said abrading members 14 having the slant face 111, such as for instance as shown in FIG. 8 of the drawings wherein the direction of rotation of the rotor 11 is clockwise and the protruding end of the abrading elements 14 is rearwards of the rotation movement of the rotor 11. Of course that the slant face abrading elements 14 may be provided in any desired number, but always in oppositely disposed pairs as shown in FIG. 8 of the drawings, whereby in said particular embodiment of the invention shown in FIG. 8, four diametrically opposite abrading members 14 have slant faces 111, whereas four abrading elements 14 comprise flat faces 110, the flat faces of the abrading elements 14 being alternately arranged with the slant faces 111 of the other abrading members 14, such that each diametrically opposed pair of identical abrading members comprises identical abrading members.

The remainder of the structure shown in FIG. 8 of the drawings is exactly the same as described above, whereby it is not considered necessary to furtherly describe the same.

FIG. 9 shows a different embodiment of the invention, wherein one single abrading member 14 and one single screen member 13 are provided, said abrading member 14 being of a semicylindrical shape and being supported or backed by means of a suitable shell member 112, and being also attached such as by suitable fasteners to a pair of diametrically oppositely arranged blocks 113, and said screen member 13 being also of a semicylindrical form, comprising a pair of flanges 42 at both side edges thereof, said flanges 42 being inserted, together with corresponding flanges 114 attached to said abrading member 14 as fastening elements thereof, into a channel provided at said block 113, and being fastened by means of a pyramidal member 115, attached to the threaded bolt 98 to which the nut 100 is also threadedly attached to fix all the elements by a pressure fit between the triangular block 115 and the complementary block 113 on each side of the screen member 13 and the abrading member 14.

In this particular instance, a plurality of reinforcing rings 53 as shown in FIG. 1 of the drawings and also in FIG. 9 thereof, must be provided, in order to prevent any deformation of the semicylindrical screen member 13. Also, in this embodiment of the invention, indentations 68 are preferably provided in said screen member 13, in order to furnish a more energetic rubbing of the grains that are introduced in the grain treating chamber 9.

It may be seen from the above that a screen and rotor assembly has been provided wherein a plurality of alternate abrading elements and screen members are arranged, which members may be from one screen member and one abrading member of semicylindrical form, up to any desired number, provided that each screen member be alternated with an abrading member throughout the circumference of the abrading screen 10.

Also, in view of the possibility of inserting shims between the bottom of the channel 32 and the abrading members 14, the abrading members may be regulated as to their radial position. For instance, said members may be arranged flush with the screen members, or radially protruding from said screen members, either by pairs of by means of an arrangement which will gradually protrude each abrading member throughout the circumference of the screen 10, so as to form a spiral abrading assembly, in order to more energetically rub the grains introduced into the grain treating chamber 9.

The mounting of the abrading members which directly fix the screen members into the channels of the screen holder, furnishes the possibility of providing for the removal of one or more screen members by the mere loosening of a reduced number of screws which attach the abrading members to said channels, whereby the screen members are also loosened and remain ready for their removal from the machine for replacement of repairing purposes. The mounting of the screen members is accomplished by the reverse action, that is, by the mere introduction from above of each one of said screen members, and the tightening of the bolts which fix the abrading members to the channels of the screen holder. This provides for a very easy and expedite manner of mounting and removing the screen members from the screen holder.

The screen and rotor assembly of the present invention is highly useful for husking, polishing, pearling and whitening various types of grains, oleaginous seeds and cereals and is suitable for being used in any type of husking or polishing machine for grains and particularly for rice. The screen and rotor assembly of the present invention may be of any suitable form and may be used in any suitable position, namely, said screen and rotor assembly may be cylindrical or frustoconical and its position may be arranged either horizontally or vertically.

The screen and rotor assembly on the other hand, has proven to be highly useful for machines for polishing par-boiled rice, because the par-boiled grain has a hardness and a fat content which are so high that it has been found that, with the prior art machines, in order to duly polish said rice, it is necessary to pass the same through at least five stages using suitable machines, and the grain must also be furtherly cleaned by air sweeping, in order to remove the flour or bran adhered thereto because of the high fat content.

The screen and rotor assembly of the present invention, when used in a machine of the type described and claimed in U.S. Pat. No. 4,292,890, for example, and as described in the detailed description above, is capable of polishing the hardest existing grain and the grain with the highest fat content such as the par-boiled rice in one single step, in view of the possibility offered by the screen and rotor assembly of the present invention, of suitably regulating the intensity of rubbing of the grain, by the mere expedient of adjusting the position of the abrading members of the screen 10 and of the abrading inserts of the rotor 11, as described above, so as to more energetically rub the grain in many different patterns of centrifugation and rubbing actions.

Although certain specific embodiments of the present invention have been described and shown above, it is to be understood that many modifications are possible. The invention, therefore, is not to be restricted except insofar as is necessitated by the prior art and by the spirit of the appended claims.

What is claimed is:

1. A screen and rotor assembly for grain husking, decorticating, polishing and whitening machines comprising, in combination, screen holder means formed by an upper rim, a lower rim and a plurality of straight channels having an upper end attached to said upper rim and a lower end attached to said lower rim; each one of said straight channels having a bottom member and a pair of side walls attached to the two side edges of said bottom member and extending radially inwardly of said screen holder means; abrading screen means supported by said screen holder means interiorly thereof and including a plurality of screen members each having a plurality of evenly distributed slots, said screen members being alternated with a corresponding plurality of abrading members, each one of said screen members having side flanges, each flange defining a radially outwardly extending member and an end member perpendicular to said radially outwardly extending member, said flanges being complementarily introduced within said straight channels of said screen holder means wherein said radially outwardly extending members engage interiorly with the side walls of said channels and said end members engage interiorly with at least part of the bottom member of said channels; said abrading members including abrading blocks each having a bottom surface, two side surfaces and a working abrading surface opposite to said bottom surface, said blocks being at least partially introduced within said channels with the bottom surface of said blocks resting against the end members of the flanges of said screen members to fix the position thereof within said channels; a plurality of adjustable fastener means to fix the radial position of said abrading blocks within said channels; and rotor means rotatably arranged concentrically inwardly of said abrading screen means and including a body, two diametrically opposite axially directed grooves on the surface of said body, and abrading inserts positioned within each of said grooves, said abrading inserts provided in the form of abrading blocks having a bottom surface abutting said grooves and an opposite working surface facing said abrading screen means, the working surface of said abrading inserts extending outwardly of said grooves a predetermined distance; and adjustable fasteners in said rotor for fixing the radial position of said abrading inserts within said grooves; the rotation of said rotor means within said abrading screen means producing movement of the grain introduced therebetween and a high intensity abrading action between said abrading members of the abrading screen means and said abrading inserts of the rotor means, the spacing between said abrading members and said abrading inserts being maintained substantially constant by adjustment of said adjustable fasteners.

2. A screen and rotor assembly according to claim 1 wherein said screen holder means and said rotor means are cylindrical.

3. A screen and rotor assembly according to claim 1 wherein said screen holder means and said rotor means are frustoconical.

4. A screen and rotor assembly according to claim 1 wherein said abrading screen means are provided with from 2 to 8 screen members alternated with from 2 to 8 abrading members, each of said abrading members being fixed to each of said straight channels of said screen holder means, to thereby sandwich the end members of the flanges of two contiguous screen members for holding the same within said channels.

5. A screen and rotor assembly according to claim 4 wherein said adjustable fasteners for said abrading members are threaded fasteners, the radial position of said abrading members being regulated by the degree of tightening of said threaded fasteners, and at least one shim introduced between the bottom of said abrading member and the bottom of said channel for fixing said regulated position.

6. A screen and rotor assembly according to claim 5 wherein said adjustable fasteners for the abrading inserts of said rotor means are threaded fasteners, the radial position of said abrading inserts being regulated by the degree of tightening of said threaded fasteners, and at least one shim introduced between the bottom surface of said abrading inserts and said grooves for fixing said regulated position.

7. A screen and rotor assembly according to claim 4 wherein said adjustable fasteners for the abrading members of said rotor are threaded fasteners, the radial position of the abrading members of said abrading screen means being regulated by the degree of tightening of said threaded fasteners, and compression spring means are provided for biasing said abrading members radially inwardly of said screen holder means to resiliently fix said regulated position of said abrading members.

8. A screen and rotor assembly according to claim 4 wherein said screen members are flat thus forming polygonal abrading screen means in conjunction with said abrading members.

9. A screen and rotor assembly according to claim 4 wherein said screen members are curved in the transverse direction thus forming cylindrical abrading screen means in conjunction with said abrading members.

10. A screen and rotor assembly according to claim 4 wherein the working surface of said abrading members is a flat surface facing said rotor means and parallel thereto.

11. A screen and rotor assembly according to claim 4 wherein the working surface of said abrading members is a slant surface facing said rotor means, the height of said slant surface increasing in a direction opposite to the direction of rotation of said rotor means.

12. A screen and rotor assembly according to claim 1 wherein said screen members are provided with indentations throughout the area thereof.

* * * * *